US007637739B2

(12) United States Patent
Nowakowski et al.

(10) Patent No.: US 7,637,739 B2
(45) Date of Patent: Dec. 29, 2009

(54) HEATING METHOD AND APPARATUS

(75) Inventors: John J. Nowakowski, Valley View, OH (US); Julius J. Lukacs, Elgin, SC (US); Todd A. Miller, Garfield Heights, OH (US); Thomas F. Robertson, Medina Township, OH (US)

(73) Assignee: Fives North American Combustion, Inc., Cleveland, OH (US)

( * ) Notice: Subject to any disclaimer, the term of this patent is extended or adjusted under 35 U.S.C. 154(b) by 613 days.

(21) Appl. No.: 11/112,781

(22) Filed: Apr. 22, 2005

(65) Prior Publication Data

US 2006/0068346 A1 Mar. 30, 2006

Related U.S. Application Data

(60) Provisional application No. 60/614,626, filed on Sep. 30, 2004.

(51) Int. Cl.
*F27B 9/00* (2006.01)

(52) U.S. Cl. ..... 432/190; 432/149; 432/121; 264/652

(58) Field of Classification Search ..... 432/146, 432/149, 190, 136, 175, 121, 128, 42, 45, 432/49; 202/88; 264/652
See application file for complete search history.

(56) References Cited

U.S. PATENT DOCUMENTS

| | | | | | |
|---|---|---|---|---|---|
| 3,108,351 | A | | 10/1963 | Hermans | |
| 4,066,470 | A | | 1/1978 | Brachthauser et al. | |
| 4,177,035 | A | * | 12/1979 | Buschermohle | 432/121 |
| 4,202,661 | A | * | 5/1980 | Lazaridis et al. | 432/8 |
| 4,240,788 | A | * | 12/1980 | Naito et al. | 432/136 |
| 4,444,557 | A | * | 4/1984 | Kimura et al. | 432/136 |
| 4,475,885 | A | | 10/1984 | Finke | |
| 4,773,851 | A | | 9/1988 | Mueller | |
| 4,778,384 | A | | 10/1988 | Lingl, Jr. | |
| 4,884,969 | A | * | 12/1989 | Kolln Bernd et al. | 432/133 |
| 4,976,607 | A | * | 12/1990 | Grimard | 431/174 |
| 5,613,847 | A | | 3/1997 | Lingl | |
| 5,730,591 | A | | 3/1998 | Robertson et al. | |
| 5,769,624 | A | * | 6/1998 | Luxton et al. | 431/284 |
| 6,116,896 | A | | 9/2000 | Joshi et al. | |
| 6,461,145 | B1 | * | 10/2002 | Giraud et al. | 431/10 |
| 6,572,369 | B2 | * | 6/2003 | Linke | 432/146 |
| 7,150,627 | B2 | * | 12/2006 | Gaur et al. | 432/144 |

OTHER PUBLICATIONS

North American Combustion Handbook, A Practical Basic Reference on the Art and Science of Industrial Heating with Gaseous and Liquid Fuels, Third Edition, vol. II, 1997, iii, iv, 36-37.

(Continued)

*Primary Examiner*—Gregory A Wilson
(74) *Attorney, Agent, or Firm*—Jones Day

(57) ABSTRACT

Hot products of combustion are provided beside an outer surface of a load to be heated, and are given a non-uniform temperature profile in a control direction extending across the outer surface of the load. The non-uniform temperature profile of the hot products of combustion is varied within a range that is predetermined relative to the distance that the outer surface of the load extends in the control direction, whereby the load can be given a predetermined temperature profile in the control direction.

41 Claims, 6 Drawing Sheets

OTHER PUBLICATIONS

Remmey, Jr., G. Bickley. Firing Ceramics. Advanced Series in Ceramics—vol. 2, pp. iii-v, 100-101, 105-106, 113-131 (1994).

North American Manufacturing Company Application Report R-Fge-101, Car-Type Forge Furnace, Aug. 1996, pp. 1-2.

North American Manufacturing Company, Hot Air ATP Adaptive Thermal Profile Low Nox Burners for High Temperature Applications, Bulletin 4472, May 2001, pp. 1-2.

North American Manufacturing Company, Variable Heat Pattern Burners, Bulletin 4808, Jan. 2002, pp. 1-2.

Hotwork, Zone Ranger Gas Burner, Bulletin ZR 75, undated prior art, 1 page.

Gilbert, K.L. Soaking Pit Innovations—Allegheny Ludlum, Reprinted from Jul. 1971 Iron & Steel Engineer, North American Reprint No. 158, 6 pages.

North American Mfg. Co., High Velocity and Fuel Directed Burners, Handbook Supplement 256, 8-90, pp. 1-8.

* cited by examiner

HEATING METHOD AND APPARATUS

RELATED APPLICATION

This application claims the benefit of provisional U.S. Patent Application Ser. No. 60/614,626 filed Sep. 30, 2004.

TECHNICAL FIELD

This technology relates to a furnace combustion system.

BACKGROUND

Ceramic or refractory materials, such as bricks, tiles and the like, are cured by firing in a furnace known as a kiln. For example, bricks may be cured by firing in a roof-fired ceramic kiln. Stacks of bricks are placed on wheeled pallets that are known as kiln cars. The kiln cars are moved slowly through the kiln from one end to the other. The kiln has a preheating zone at one end, a cooling zone at the opposite end, and a heating zone in between. Burners and/or injectors at the roof of the kiln cause flames to project downward into the heating zone to heat the bricks as they move through the kiln.

Typically, the stacks of bricks are spaced apart from each other and are indexed through the kiln. The flames are projected downward into the spaces between the stacks of bricks for a period of time. The kiln cars are then advanced forward to their next positions, and the flames are again projected downward into the spaces between the stacks of bricks. This process repeats until all of the stacks of bricks have been moved sequentially through the preheating zone, the heating zone, and the cooling zone to emerge from the kiln in a heat-treated state.

The burners and injectors in a roof-fired kiln can be arranged in long rows above a wide area. However, projecting the flames downward from above can cause the stacks of bricks to become heated more quickly near the top than the bottom.

SUMMARY

The claimed invention provides a method and apparatus for controlling the temperature profile of a load that is heated in a furnace.

In the method, fuel and oxidant are injected separately into a combustion zone such that mixing and auto-ignition of the fuel and oxidant within the combustion zone provide hot products of combustion beside an outer surface of a load to be heated. The hot products of combustion are given a non-uniform temperature profile in a control direction extending across the outer surface of the load. The non-uniform temperature profile of the hot products of combustion is varied throughout a range that is predetermined relative to the distance that the outer surface of the load extends in the control direction. This enables the load to be given a predetermined temperature profile in the control direction.

For example, the invention can be used to impart a substantially uniform vertical temperature profile to a ceramic load in a kiln. The following description presents such an example in which the outer surface of the load is a vertical surface, the control direction is vertical, and the hot products of combustion include a flame projecting in the vertical direction beside the outer surface of the load. The non-uniform vertical temperature profile of the hot products of combustion is varied by varying the length of the flame.

The invention further provides a method of retrofitting an apparatus by providing it with parts that are operative to perform as recited in the claims. It follows that the invention includes the retrofitted apparatus, and the parts used to retrofit the apparatus, as well as an originally constructed apparatus.

DETAILED DESCRIPTION

Figure 1:
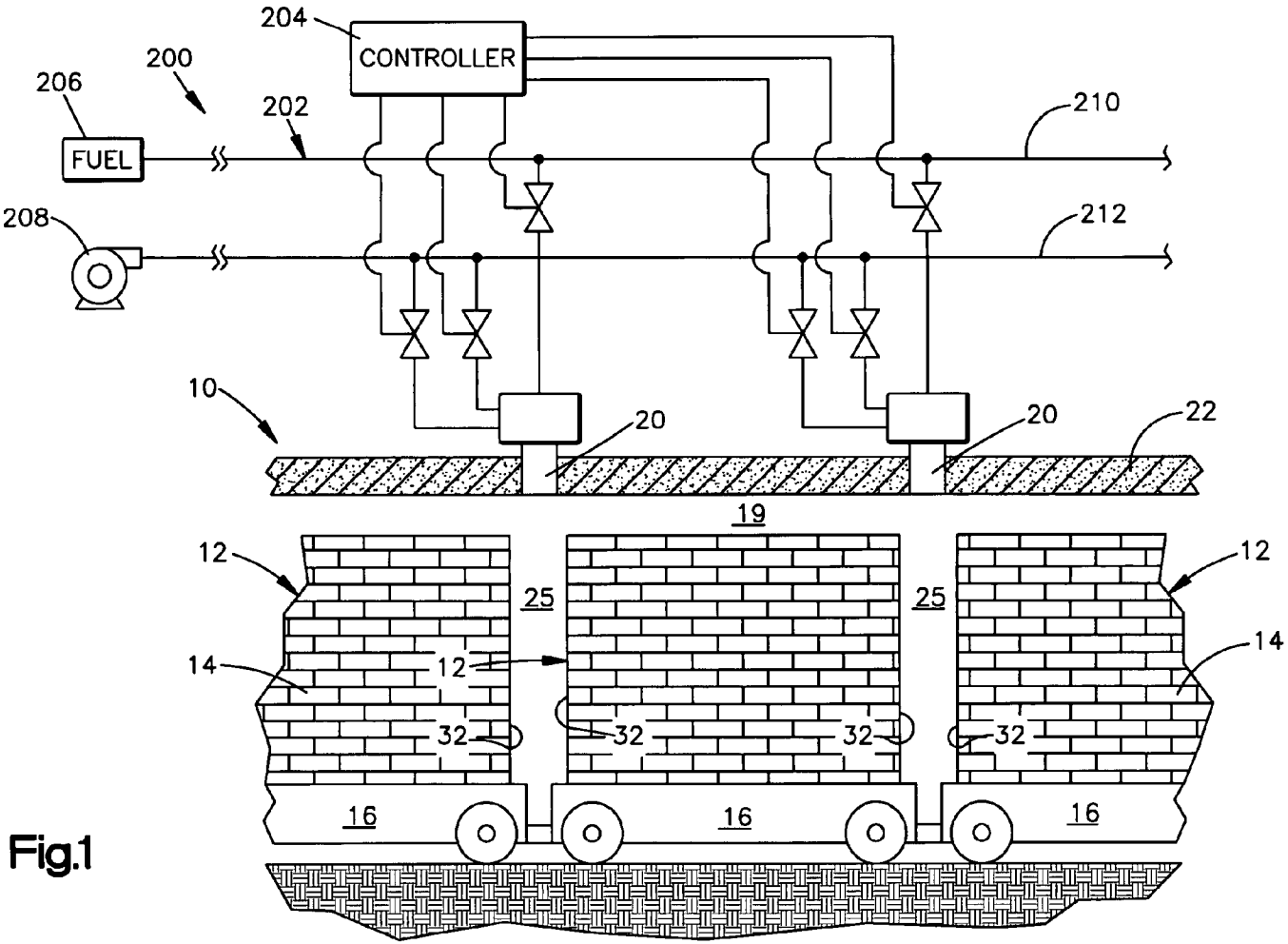
FIG. 1 is a schematic illustration of a tunnel kiln with roof-mounted injectors and an injector control apparatus.

The structure 10 shown schematically in FIG. 1 can be constructed and operated in steps that are examples of the elements recited in the method claims, and has parts that are examples of the structural elements recited in the apparatus claims. The illustrated structure 10 thus includes examples of how a person of ordinary skill in the art can make and use the claimed invention. It is described here to meet the enablement and best mode requirements of the patent statute without imposing limitations that are not recited in the claims. This particular structure 10 is a roof-fired tunnel kiln in which roof-mounted injectors are operated between stacks of bricks to impart predetermined vertical temperature profiles to the stacks of bricks. The various parts of the kiln 10, as shown, described and claimed, may be of either original and/or retrofitted construction as required to accomplish any particular implementation of the invention.

In this example, stacks 12 of bricks 14 are carried on kiln cars 16 that are moved through the kiln 10 from one end to the other. The kiln 10 has a preheating zone (not shown), a heating zone 19, and a cooling zone (not shown). The kiln cars 16 are moved from left to right, as viewed in FIG. 1, first through the preheating zone, then through the heating zone 19, and finally through the cooling zone. Injectors 20 at the roof 22 of the kiln 10 are operative to inject combustible reactants downward into the heating zone 19. Burners (not shown) at other locations in the kiln 10 initially bring the heating zone 19 to an elevated temperature at which the reactants emitted from the injectors 20 will auto-ignite to provide heat for curing the bricks 14. Such burners are known in the art and may be arranged and operated in any suitable manner known in the art.

The stacks 12 of bricks 14 are either indexed or moved continuously through the kiln 10. The injectors 20 are aimed vertically downward toward the spaces 25 between the stacks 12 of bricks 14 on adjacent kiln cars 16. If the stacks 12 of bricks 14 are indexed through the kiln 10, the injectors 20 may be operated for a time interval of, for example, about half an hour. The stacks 12 of bricks 14 are then advanced forward to a next position as the kiln cars 16 are rolled intermittently forward, and the injectors 20 are again operated toward and into the spaces 25 between the stacks 12 of bricks 14 for another time interval. This process repeats until all of the stacks 12 of bricks 14 have been moved sequentially through the heating zone 19.

The kiln cars 16 are arranged beside each other as shown in FIG. 1. The injectors 20 are arranged at the roof 22 of the kiln 10 in multiple rows that are perpendicular to the direction of movement of the kiln cars 16 through the kiln 10. FIG. 1 shows one injector 20 in each of a pair of two adjacent rows. In this arrangement, each injector 20 can cause a flame to project downward between the adjacent vertical outer surfaces 32 of two adjacent brick stacks 12. Additionally, each injector 20 of FIG. 1 can be operated to provide a flame with a profile that is controlled by the operator. In this manner, the injectors 20 can heat the spaces 25 between adjacent brick stacks 12 with vertical temperature profiles that are likewise controlled by the operator. This enables the stacks 12 of bricks 14 to obtain predetermined vertical temperature profiles, including substantially uniform vertical temperature profiles.

Figure 2:
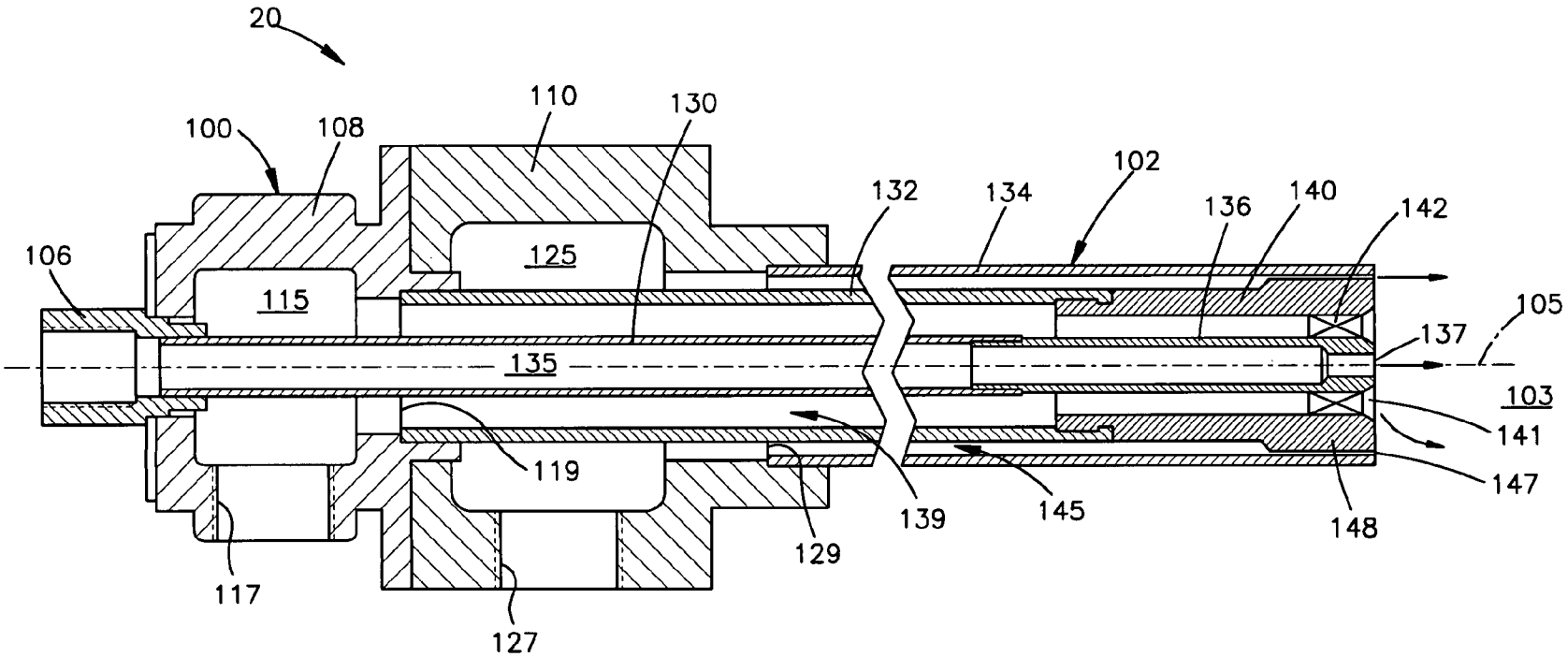
FIG. 2 is an enlarged sectional view of an injector shown in FIG. 1.

The injectors 20 used in the illustrated example are all alike, and each has the structure of the variable heat pattern injector shown in FIG. 2. Each injector 20 thus has a rearward body portion 100 and a forwardly extending tubular portion 102. The body portion 100 is a generally box-like structure depicted on the left hand side of FIG. 2, and the tubular portion 102, depicted on the right hand side of FIG. 2, extends between the body 100 and the combustion zone 103 along a central axis 105.

Each injector body 100 has three parts 106, 108 and 110 that together convey the reactants to the tubular portion 102. The first part 106 of the body 100 is a coupling for receiving the end of a fuel line. The second part 108 has a chamber 115, an integral coupling 117 for receiving an air line, and an air outlet 119. The third part 110 also has a chamber 125, an integral coupling 127 for receiving an air line, and an air outlet 129. These three parts 106, 108 and 110 of the body 100 are aligned with each other so that the fuel coupling 106 and the air outlets 119 and 129 are located concentrically on the axis 105.

The tubular portion 102 of the injector 20 includes three concentric cylindrical tubes 130, 132, and 134. The inner tube 130 defines an inner passage 135 through which fuel travels. A rearward end of the inner tube 130 is connected to the coupling 106. A cylindrical extension structure 136 is coupled to the forward end of the inner tube 130 to extend the inner passage 135 to the forward end of the tubular portion 102. The inner diameter of the extension structure 136 becomes narrower at its forward end to form a nozzle with a fuel injection port 137 through which fuel can enter the combustion zone 103.

The middle tube 132 is concentric with the inner tube 130 so that the inner wall surface of the middle tube 132 and the outer wall surface of the inner tube 130 define an annular middle passage 139 though which air travels. A rearward end of the middle tube 132 is connected to the second body part 108 so that the chamber 115 in the second body part 108 communicates with the middle passage 139 through the adjacent outlet opening 119. At the forward end, the middle tube 132 is coupled to a cylindrical extension structure 140. That extension structure 140 extends the middle passage 139 from the middle tube 132 to the forward end of the tubular portion 102, and surrounds a first air injection port 141 through which air traveling in the middle passage 139 can enter the combustion zone 103. Spin vanes 142 are located within the extension structure 140 near the first air injection port 141.

The outer tube 134 is concentrically received over the middle tube 132 so that the inner wall surface of the outer tube 134 and the outer wall surface of the middle tube 132 define an annular outer passage 145 through which air travels. A rearward end of the outer tube 134 is coupled to the third body part 110 so that the chamber 125 in the third body part 110 communicates with the outer passage 145 through the adjacent outlet opening 129. At the forward end, the outer tube 134 surrounds a second air injection port 147 through which air enters the combustion zone 103. A thickened portion 148 of the adjacent extension structure 140 provides the second air injection port 147 with a relatively constricted flow area to increase the exit velocity for a given flow rate of air through the outer passage 145.

As thus far described, the injector 20 is configured to inject separate streams of unignited reactants into the combustion zone 103. When the reactants form a combustible mixture within the combustion zone 103, auto-ignition at the elevated temperature of the combustion zone 103 causes the reactants to produce hot products of combustion that include a flame with a controlled length.

More specifically, the reactants include fuel and oxygen. Natural gas is the preferred fuel. A stream of natural gas delivered to the fuel coupling 106 will flow through the inner passage 135, and will enter the combustion zone 103 through the fuel injection port 137. Air is the preferred oxidant. A first stream of air, referred to as spin air, delivered to the first air inlet 117 will flow through the adjoining chamber 115 and the middle passage 139, and will enter the combustion zone 103 through the first air injection port 141. The spin vanes 142 impart a spin to the stream of spin air so that it will merge and form a combustible mixture with the fuel at a relatively short distance spaced axially from the fuel port 137. This has the effect of producing a correspondingly short flame for given flow rates of the fuel and spin air streams.

A second stream of air, referred to as forward air, delivered to the second air coupling 127 will flow through the adjoining chamber 125 and the outer passage 145. The stream of forward air will enter the combustion chamber 103 at the radially outer location of the second air injection port 147, and will form a combustible mixture with the fuel farther along the axis 105 as compared with the spin air. This has the effect of lengthening the flame along the axis 105. Therefore, the length of the flame can be controlled and varied by controlling and varying the proportional amounts of spin air and forward air. The temperature gradient or profile of the hot products of combustion extending along the axis 105 in the combustion zone 103 can be controlled and varied accordingly.

As shown in FIG. 1, the kiln 10 has an injector control system 200 for operating the roof-mounted injectors 20. In the illustrated example, the injector control system 200 includes a reactant supply system 202 and a controller 204 that controls the reactant supply system 202. The controller 204 shown schematically in the drawings may comprise any suitable programmable logic controller or other control device, or combination of control devices, that is programmed or otherwise configured to perform as recited in the claims. A fuel source 206, which in this particular implementation is a supply of natural gas, and an oxidant source 208, which in this particular implementation is an air blower, provide streams of those reactants along respective supply lines 210 and 212. As shown in enlarged detail in FIG. 3, the fuel coupling 106 on each injector 20 communicates with the fuel supply line 210 through a branch line 216 with a fuel control valve 218. The air couplings 117 and 127 on each injector 20 communicate with the oxidant supply line 212 through branch lines 220 and 222 and oxidant control valves 224 and 226, respectively.

Figure 3:
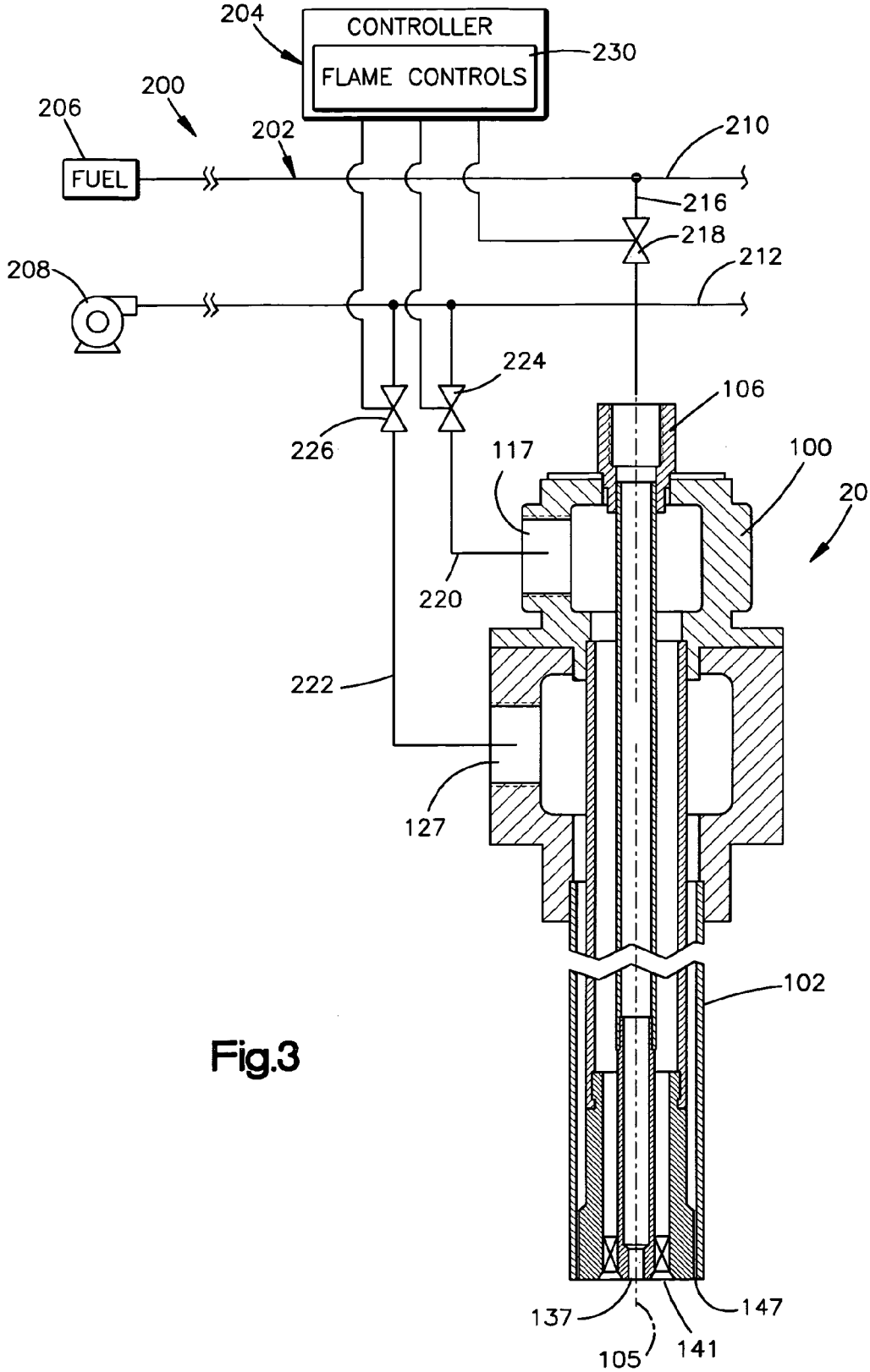
FIG. 3 is an enlarged view of parts shown in FIGS. 1 and 2.

As further shown in FIG. 3, the controller 204 has flame controls 230 in the form of hardware and/or software for operation of an injector 20 in the manner described above. As the controller 204 carries out those instructions, it actuates the valves 218, 224 and 226 to initiate, regulate and terminate flows of reactant streams that provide a flame with a predetermined length projecting axially downward beneath the injector 20. For example, in a first mode of operation the controller 204 maintains the second oxidant control valve 226 in a closed condition while the fuel control valve 218 and the first oxidant control valve 224 are in open conditions. This provides the injector 20 with oxidant in the form of only spin air at the first air coupling 117. For given flow rates of the fuel and spin air streams, this mode of operation provides a flame with the shortest available length.

In a second mode of operation, the controller 204 maintains the first oxidant control valve 224 in a closed condition while the fuel control valve 218 and the second oxidant control valve 226 are in open conditions. This provides the injector 20 with oxidant in the form of only forward air at the second air coupling 127. For given flow rates of the fuel and forward air streams, this mode of operation provides a flame with the greatest available length. In addition to these two modes of operation, the controller 204 provides an infinite range of intermediate modes in which the first and second oxidant control valves 224 and 226 have open conditions that provide the injector 220 with streams of both spin air and forward air, with an infinite range of corresponding intermediate flame lengths.

Figure 4:
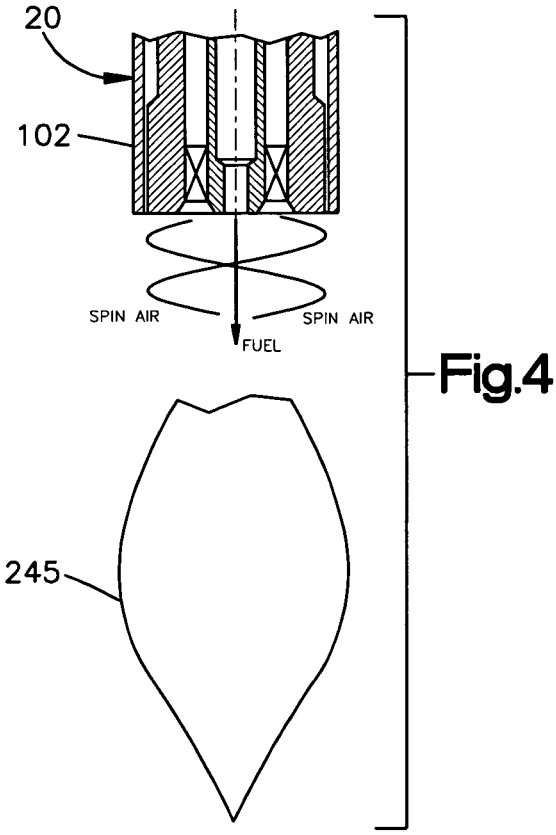
FIG. 4 shows a flame produced in a first mode of operation.
Figure 5:
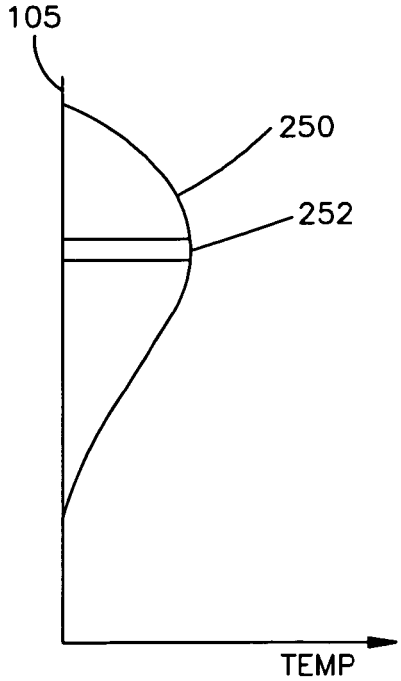
FIG. 5 is a graphic illustration of the vertical temperature profile of the flame of FIG. 4.
Figure 6:
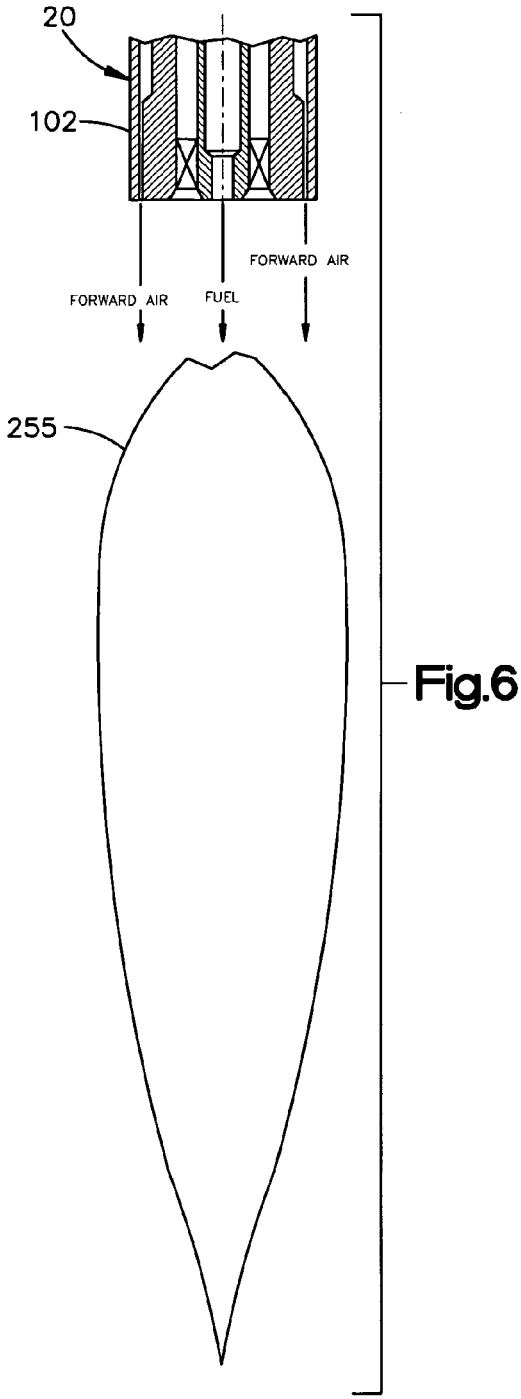
FIG. 6 shows a flame produced in a second mode of operation.
Figure 7:
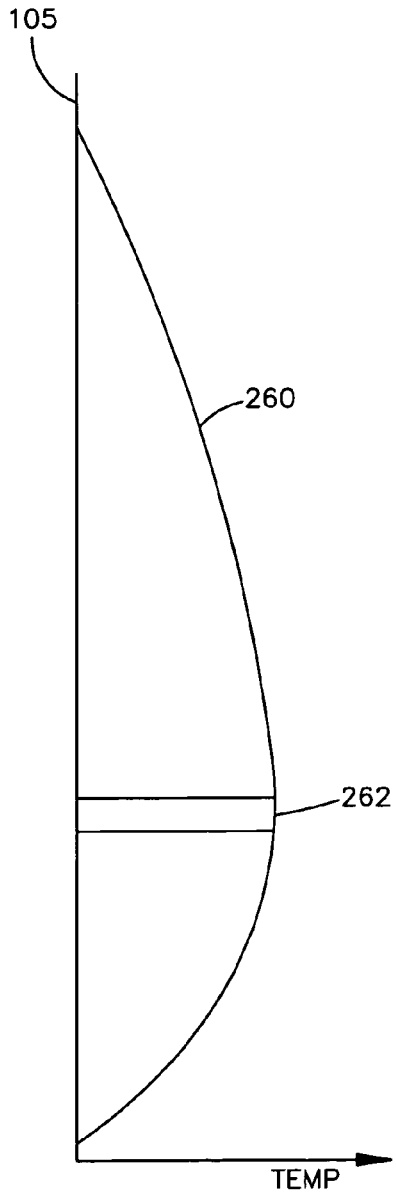
FIG. 7 is a graphic illustration of the vertical temperature profile of the flame of FIG. 6.
Figure 8:
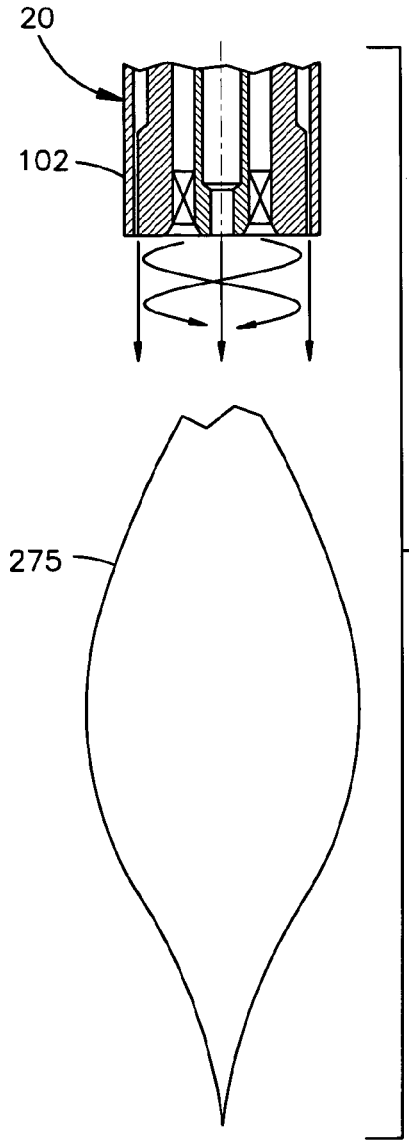
FIG. 8 shows a flame produced in an intermediate mode of operation.
Figure 9:
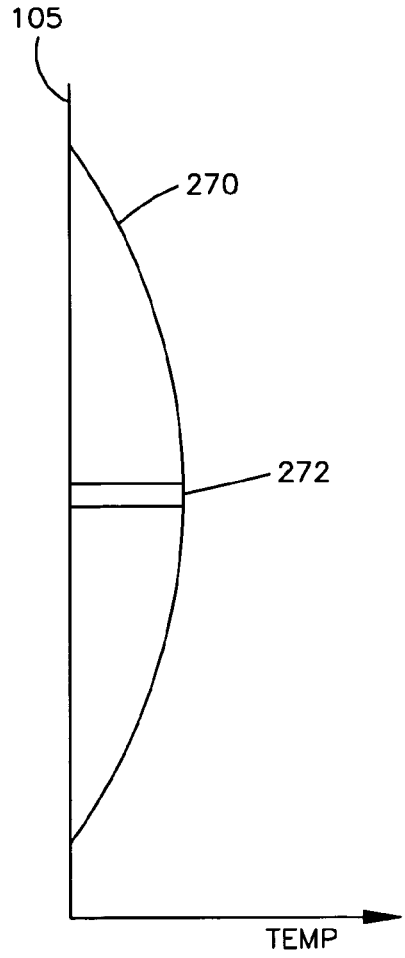
FIG. 9 is a graphic illustration of the vertical temperature profile of the flame of FIG. 8.

A short flame 245 produced in the first mode of operation is illustrated in FIG. 4. That flame 245 has a vertical temperature profile 250 extending along the axis 105 of the injector 20, indicated qualitatively in FIG. 5. The profile 250 is non-uniform, with the horizontal band 252 shown in FIG. 5 representing a single section of the profile 250 in which the highest flame temperature is located. In contrast, the long flame 255 of FIG. 6, which is an example of a flame produced in the second mode of operation, has the non-uniform vertical temperate profile 260 of FIG. 7. The hottest section 262 of that profile 260 is vertically lower than the hottest section 252 of the short flame profile 250 of FIG. 5. The intermediate profile 270 of FIG. 9, with its relatively mid-height section 272 of highest temperature, is thus obtained by a flame 275 produced in an intermediate mode, as shown in FIG. 8.

When an injector 20 of FIG. 1 is operated to provide a flame that projects downward beside a vertical outer surface 32 of a brick stack 12, the vertical outer surface 32 is heated with a vertical temperature profile approaching that of the flame. If the flame were unchanged throughout the time it remains beside the surface 32, the brick stack 12 would obtain a vertical temperature profile which, like that of the flame, is vertically non-uniform. However, each injector 20 in the kiln 10 can be operated in any combination and sequence of the differing modes that provide the flame with differing vertical temperature profiles. By varying the profile of the flame in this manner, the controller 204 can vary the amount of heat that is transferred to the surface 32 at all locations along the height of the surface 32. For example, the hottest section of a flame profile can be shifted vertically beside the surface 32 so that adjacent sections of the surface 32, and the underlying mass of bricks 14, can be heated in predetermined amounts that correspond to the temperature and dwell time of the hottest flame section. The hottest flame section could thus be moved throughout a range that is coextensive with the height of the surface 32 from top to bottom in a manner that is predetermined to provide the stack 12 of bricks 14 with a substantially uniform vertical temperature profile. The invention thus enables a load to be heated to a predetermined temperature profile by varying the length of the flame, and thereby the temperature profile of the hot products of combustion beside a surface of the load, within a range that is predetermined relative to the distance that the outer surface of the load extends in the control direction.

Moreover, when the controller 204 actuates the oxidant control valves 224 and 226 to vary the flame length beneath an injector 20 as described above, it can maintain the total oxidant flow rate at the injector 20 substantially constant even though the spin air and forward air flow rates are varied. The heat input of the flame depends on the flow rates of the reactants emerging from the injector 20. Therefore, if the fuel flow rate also is maintained substantially constant, the heat input of the flame will be maintained substantially constant throughout the variations in flame length. Maintaining the heat input at a substantially constant level provides greater control of the temperature profile imparted to the load by the shifting flame profile.

This written description sets forth the best mode of carrying out the invention, and describes the invention so as to enable a person skilled in the art to make and use the invention, by presenting examples of the elements recited in the claims. The patentable scope of the invention is defined by the claims, and may include other examples that occur to those skilled in the art. Such other examples, which may be available either before or after the application filing date, are intended to be within the scope of the claims if they have structural or process elements that do not differ from the literal language of the claims, or if they have equivalent structural or process elements with insubstantial differences from the literal language of the claims.

The invention claimed is:

1. An apparatus comprising:

a furnace having an injector and injector control apparatus that are a) configured to inject fuel and oxidant separately into a combustion zone in the furnace such that mixing and auto-ignition of the fuel and oxidant within the combustion zone produce hot products of combustion beside an outer surface of a load to be heated in the furnace, b) configured to give the hot products of combustion a non-uniform temperature profile in a control direction extending across the outer surface of the load, and c) configured to vary the non-uniform temperature profile of the hot products of combustion in a controlled manner with reference to a range that is predetermined relative to the distance that the outer surface of the load extends in the control direction, whereby the load can be given a predetermined temperature profile in the control direction.

2. An apparatus as defined in claim 1 wherein the injector and injector control apparatus are configured to inject the fuel and oxidant separately into the combustion zone at substantially constant rates so as to maintain the heat input of the hot products of combustion substantially constant while varying the non-uniform temperature profile.

3. An apparatus as defined in claim 1 wherein the injector and injector control apparatus are configured to give the hot products of combustion a non-uniform temperature profile that has a single highest temperature section, and to vary the non-uniform temperature profile of the hot products of combustion by shifting the location of the single highest temperature section in the control direction.

4. An apparatus as defined in claim 1 wherein the injector and injector control apparatus are configured to project a flame in the control direction beside the outer surface of the load, and to vary the non-uniform temperature profile of the hot products of combustion by varying the length of the flame.

5. An apparatus as defined in claim 1 wherein the injector and injector control apparatus are configured to project a flame in the control direction beside the outer surface of the 1oad, configured to give the flame a non-uniform temperature profile by injecting the fuel and oxidant from the injector in separate fuel and oxidant streams having configurations that cause the fuel and oxidant streams to merge and form a combustible mixture at a location spaced from the injector in the control direction, and configured to vary the non-uniform temperature profile of the flame by varying the configurations of the fuel and oxidant streams so as to vary the location at which the fuel and oxidant streams form the combustible mixture.

6. An apparatus as defined in claim 1 wherein the injector and injector control apparatus are configured to vary the non-uniform temperature profile of the hot products of combustion so as to give the load a predetermined temperature profile that is substantially uniform in the control direction.

7. An apparatus as defined in claim 1 wherein control direction is vertical.

8. An apparatus as defined in claim 1 wherein the furnace is a kiln.

9. An apparatus as defined in claim 8 wherein the kiln is a tunnel kiln.

10. An apparatus comprising:

a kiln with an injector and injector control apparatus that are a) configured to inject fuel and oxidant separately into a combustion zone in the kiln such that mixing and auto-ignition of the fuel and oxidant within the combustion zone produce hot products of combustion beside a vertical outer surface of a stationary ceramic load in the kiln, b) configured to give the hot products of combustion a non-uniform vertical temperature profile, and c) configured to vary the non-uniform vertical temperature profile of the hot products of combustion in a controlled manner with reference to a range that is predetermined relative to the height of the vertical outer surface from top to bottom, whereby the stationary ceramic load can be given a predetermined vertical temperature profile.

11. An apparatus as defined in claim 10 wherein the injector and injector control apparatus are configured to inject the fuel and oxidant separately into the combustion zone at substantially constant rates so as to maintain the heat input of the hot products of combustion substantially constant while varying the non-uniform vertical temperature profile.

12. An apparatus as defined in claim 10 wherein the injector and injector control apparatus are configured to give the hot products of combustion a non-uniform vertical temperature profile that has a single highest temperature section, and to vary the non-uniform vertical temperature profile by shifting the height of the single highest temperature section relative to the vertical outer surface of the stationary ceramic load.

13. An apparatus as defined in claim 10 wherein the injector and injector control apparatus are configured to project a flame downward beside the vertical outer surface of the stationary ceramic load, and to vary the non-uniform vertical temperature profile of the hot products of combustion by varying the length of the flame.

14. An apparatus as defined in claim 10 wherein the injector and injector control apparatus are configured to project a flame downward beside the vertical outer surface of the stationary ceramic load, configured to give the flame a non-uniform vertical temperature profile by injecting the fuel and oxidant downward from the injector in separate fuel and oxidant streams having configurations that cause the fuel and oxidant streams to merge and form a combustible mixture at a location spaced downward from the injector, and configured to vary the non-uniform vertical temperature profile of the flame by varying the configurations of the fuel and oxidant streams so as to vary the vertical location at which the fuel and oxidant streams form the combustible mixture.

15. An apparatus as defined in claim 10 wherein the injector and injector control apparatus are configured to vary the non-uniform vertical temperature profile of the hot products of combustion so as to give the stationary ceramic load a substantially uniform vertical temperature profile.

16. An apparatus as defined in claim 10 wherein the kiln is a tunnel kiln, and the injector and injector control apparatus are configured to function as recited in claim 10 while the stationary ceramic load is between intermittent forward movements through the tunnel kiln.

17. An apparatus comprising:

a tunnel kiln having a roof-mounted injector and injector control apparatus that are a) configured to project a flame downward beside a vertical outer surface of a ceramic load in the tunnel kiln, b) configured to give the flame a non-uniform vertical temperature profile, and c) configured to maintain a substantially constant heat input of the flame, and simultaneously to vary the non-uniform vertical temperature profile of the flame in a controlled manner with reference to a range that is predetermined relative to the height of the vertical outer surface from top to bottom, whereby a predetermined vertical temperature profile can be imparted to the ceramic load.

18. An apparatus as defined in claim 17 wherein the roof-mounted injector and injector control apparatus are configured to project the flame downward by injecting fuel and oxidant separately downward into a combustion zone in the tunnel kiln, and to maintain a substantially constant heat input of the flame by injecting the fuel and oxidant at substantially constant rates.

19. An apparatus as defined in claim 17 wherein the roof-mounted injector and injector control apparatus are configured to give the flame a non-uniform vertical temperature profile that has a single highest temperature section, and to vary the non-uniform vertical temperature profile of the flame by shifting the height of the single highest temperature section relative to the vertical outer surface of the ceramic load.

20. An apparatus as defined in claim 17 wherein the roof-mounted injector and injector control apparatus are configured to vary the non-uniform vertical temperature profile of the flame by varying the length of the flame.

21. An apparatus as defined in claim 17 wherein the roof-mounted injector and injector control apparatus are configured to give the flame the non-uniform vertical temperature profile by injecting fuel and oxidant downward from the roof-mounted injector in separate fuel and oxidant streams having configurations that cause the fuel and oxidant streams to merge and form a combustible mixture at a location spaced downward from the roof-mounted injector, and are configured to vary the non-uniform vertical temperature profile of the flame by varying the configurations of the fuel and oxidant streams so as to vary the vertical location at which the fuel and oxidant streams form the combustible mixture.

22. An apparatus as defined in claim 17 wherein the roof-mounted injector and injector control apparatus are configured to vary the non-uniform vertical temperature profile of the flame so as to give the ceramic load a substantially uniform temperature profile.

23. An apparatus comprising:

an injector and injector control apparatus that are a) configured to inject fuel and oxidant separately into a combustion zone in a furnace such that mixing and auto-ignition of the fuel and oxidant within the combustion zone produce hot products of combustion beside an outer surface of a load to be heated in the furnace, b) configured to give the hot products of combustion a non-uniform temperature profile in a control direction extending across the outer surface of the load, and c) configured to vary the non-uniform temperature profile of the hot products of combustion in a controlled manner with reference to a range that is predetermined relative to the distance that the outer surface extends in the control direction, whereby the load can be given a predetermined temperature profile in the control direction.

24. An apparatus as defined in claim 23 wherein the injector and injector control apparatus are configured to inject the fuel and oxidant separately into the combustion zone at substantially constant rates so as to maintain the heat input of the hot products of combustion substantially constant while varying the non-uniform temperature profile.

25. An apparatus as defined in claim 23 wherein the injector and injector control apparatus are configured to give the hot products of combustion a non-uniform temperature profile that has a single highest temperature section, and to vary the non-uniform temperature profile of the hot products of combustion by shifting the location of the single highest temperature section in the control direction.

26. An apparatus as defined in claim 23 wherein the injector and injector control apparatus are configured to project a flame in the control direction beside the outer surface of the load, and to vary the non-uniform temperature profile of the hot products of combustion by varying the length of the flame.

27. An apparatus as defined in claim 23 wherein the injector and injector control apparatus are configured to project a flame in the control direction beside the outer surface of the load, configured to give the flame a non-uniform temperature profile by injecting the fuel and oxidant from the injector in separate fuel and oxidant streams having configurations that cause the fuel and oxidant streams to merge and form a combustible mixture at a location spaced from the injector in the control direction, and configured to vary the non-uniform temperature profile of the flame by varying the configurations of the fuel and oxidant streams so as to vary the location at which the fuel and oxidant streams form the combustible mixture.

28. An apparatus as defined in claim 23 wherein the injector and injector control apparatus are configured to vary the non-uniform temperature profile of the hot products of combustion so as to give the load a predetermined temperature profile that is substantially uniform in the control direction.

29. An apparatus as defined in claim 23 wherein control direction is vertical.

30. An apparatus comprising:

an injector and injector control apparatus that are a) configured to inject fuel and oxidant separately into a combustion zone in a kiln such that mixing and auto-ignition of the fuel and oxidant within the combustion zone produce hot products of combustion beside a vertical outer surface of a stationary ceramic load in the kiln, b) configured to give the hot products of combustion a non-uniform vertical temperature profile, and c) configured to vary the non-uniform vertical temperature profile of the hot products of combustion in a controlled manner with reference to a range that is predetermined relative to the height of the vertical outer surface from top to bottom, whereby the stationary ceramic load can be given a predetermined vertical temperature profile.

31. An apparatus as defined in claim 30 wherein the injector and injector control apparatus are configured to inject the fuel and oxidant separately into the combustion zone at substantially constant rates so as to maintain the heat input of the hot products of combustion substantially constant while varying the non-uniform temperature profile.

32. An apparatus as defined in claim 30 wherein the injector and injector control apparatus are configured to give the hot products of combustion a non-uniform vertical temperature profile that has a single highest temperature section, and to vary the non-uniform vertical temperature profile by shifting the height of the single highest temperature section relative to the vertical outer surface of the stationary ceramic load.

33. An apparatus as defined in claim 30 wherein the injector and injector control apparatus are configured to project a flame downward beside the vertical outer surface of the stationary ceramic load, and to vary the non-uniform vertical temperature profile of the hot products of combustion by varying the length of the flame.

34. An apparatus as defined in claim 30 wherein the injector and injector control apparatus are configured to project a flame downward beside the vertical outer surface of the stationary ceramic load, configured to give the flame a non-uniform vertical temperature profile by injecting the fuel and oxidant downward from the injector in separate fuel and oxidant streams having configurations that cause the fuel and oxidant streams to merge and form a combustible mixture at a location spaced downward from the injector, and configured to vary the non-uniform vertical temperature profile of the flame by varying the configurations of the fuel and oxidant streams so as to vary the vertical location at which the fuel and oxidant streams form the combustible mixture.

35. An apparatus as defined in claim 30 wherein the injector and injector control apparatus are configured to vary the non-uniform vertical temperature profile of the hot products of combustion so as to give the stationary ceramic load a substantially uniform vertical temperature profile.

36. An apparatus comprising:

an injector and injector control apparatus that are a) configured to project a flame downward beside a vertical outer surface of a ceramic load in a tunnel kiln, b) configured to give the flame a non-uniform vertical temperature profile, and c) configured to maintain a substantially constant heat input of the flame, and simultaneously to vary the non-uniform vertical temperature profile of the flame in a controlled manner with reference to a range that is predetermined relative to the height of the vertical outer surface from top to bottom, whereby a predetermined vertical temperature profile can be imparted to the ceramic load.

37. An apparatus as defined in claim 36 wherein the an injector and injector control apparatus are configured to project the flame downward by injecting fuel and oxidant separately downward into a combustion zone in the tunnel kiln, and to maintain a substantially constant heat input of the flame by injecting the fuel and oxidant at substantially constant rates.

38. An apparatus as defined in claim 36 wherein the injector and injector control apparatus are configured to give the flame a non-uniform vertical temperature profile that has a single highest temperature section, and to vary the non-uniform vertical temperature profile of the flame by shifting the height of the single highest temperature section relative to the vertical outer surface of the ceramic load.

39. An apparatus as defined in claim 36 wherein the injector and injector control apparatus are configured to vary the non-uniform vertical temperature profile of the flame by varying the length of the flame.

40. An apparatus as defined in claim 36 wherein the injector and injector control apparatus are configured to give the flame the non-uniform vertical temperature profile by injecting fuel and oxidant downward from the injector in separate fuel and oxidant streams having configurations that cause the fuel and oxidant streams to merge and form a combustible mixture at a location spaced downward from the injector, and are configured to vary the non-uniform vertical temperature profile of the flame by varying the configurations of the fuel and oxidant streams so as to vary the vertical location at which the fuel and oxidant streams form the combustible mixture.

41. An apparatus as defined in claim 36 wherein the injector and injector control apparatus are configured to vary the non-uniform vertical temperature profile of the flame so as to give the ceramic load a substantially uniform temperature profile.

* * * * *